US009238565B2

(12) United States Patent
Miyashita

(10) Patent No.: US 9,238,565 B2
(45) Date of Patent: Jan. 19, 2016

(54) SHEET PROCESSING METHOD, SHEET PROCESSING APPARATUS, AND SHEET PROCESSING SYSTEM

(71) Applicant: Kabushiki Kaisha Toshiba, Tokyo (JP)

(72) Inventor: Morimasa Miyashita, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/200,172

(22) Filed: Mar. 7, 2014

(65) Prior Publication Data

US 2014/0284864 A1 Sep. 25, 2014

(30) Foreign Application Priority Data

Mar. 21, 2013 (JP) ..... 2013-058942

(51) Int. Cl.

| | |
|---|---|
| ***B65H 33/00*** | (2006.01) |
| ***B07C 3/18*** | (2006.01) |
| ***B65H 29/62*** | (2006.01) |
| ***B65H 33/04*** | (2006.01) |
| ***G07D 7/20*** | (2006.01) |
| ***G07D 11/00*** | (2006.01) |
| ***B65H 7/20*** | (2006.01) |

(52) U.S. Cl.

CPC *B65H 33/00* (2013.01); *B07C 3/18* (2013.01); *B65H 7/20* (2013.01); *B65H 29/62* (2013.01); *B65H 33/04* (2013.01); *G07D 7/2075* (2013.01); *G07D 11/0084* (2013.01); *B65H 2301/426* (2013.01); *B65H 2511/512* (2013.01)

(58) Field of Classification Search

CPC .... B07C 3/18; B65H 2511/512; B65H 33/04; B65H 33/00; B65H 2301/426; B65H 29/62; B65H 7/20

USPC ..... 270/52.03, 52.04, 58.02, 58.04, 58.31, 270/58.33

See application file for complete search history.

(56) References Cited

U.S. PATENT DOCUMENTS

| | | | | |
|---|---|---|---|---|
| 3,457,424 | A * | 7/1969 | Jordan et al. | 250/227.11 |
| 6,955,263 | B2 * | 10/2005 | Steinkogler et al. | 209/534 |
| 7,789,243 | B2 * | 9/2010 | Hornung et al. | 209/534 |
| 2002/0040865 | A1 | 4/2002 | Steinkogler et al. | |
| 2003/0023342 | A1 | 1/2003 | Christl et al. | |
| 2005/0147296 | A1 | 7/2005 | Hilton et al. | |
| 2006/0011447 | A1 | 1/2006 | Hornung et al. | |

FOREIGN PATENT DOCUMENTS

JP 2006-099391 A 4/2006

OTHER PUBLICATIONS

Extended European Search Report issued in related European Patent Application No. 14158054.8 mailed Jun. 26, 2014, 8 pages.

* cited by examiner

*Primary Examiner* — Leslie A Nicholson, III
(74) *Attorney, Agent, or Firm* — Baker Botts L.L.P.

(57) ABSTRACT

According to one embodiment, a sheet processing method of a sheet processing apparatus having a plurality of processing modes includes taking in sheets one by one from a bundle of the sheets in which a batch card having identification information, and the sheets as mediums to be inspected are piled, conveying the sheet which has been taken in, discriminating a kind of the batch card, switching the processing mode of the sheet processing apparatus based on the kind of the batch card which has been discriminated, discriminating and counting the sheets subsequent to the batch card, storing a count result of the sheets in correlation with the identification information, and sorting the sheet into a stacker based on a discrimination result of the sheet.

5 Claims, 12 Drawing Sheets

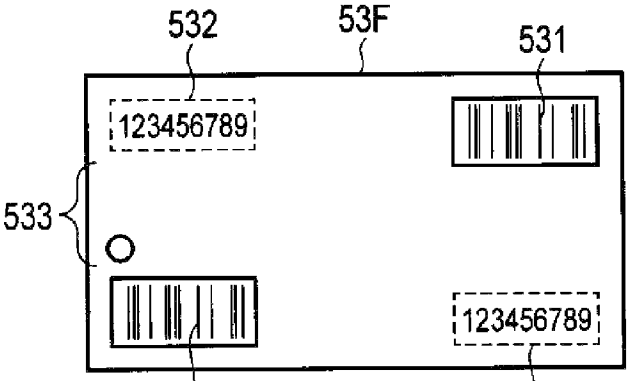
FIG. 11A
FIG. 11B
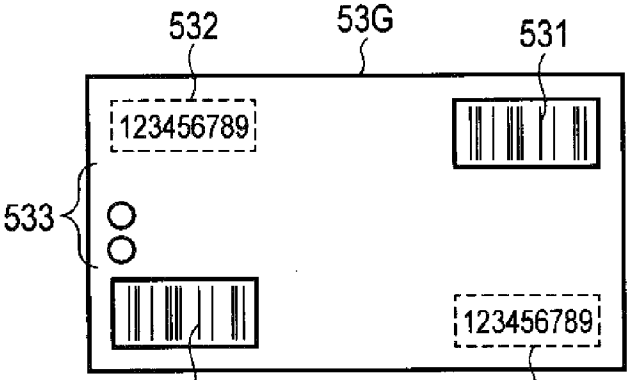
FIG. 11C
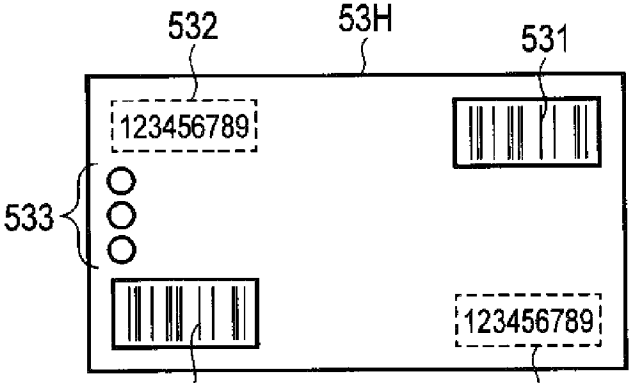
FIG. 11D

SHEET PROCESSING METHOD, SHEET PROCESSING APPARATUS, AND SHEET PROCESSING SYSTEM

CROSS-REFERENCE TO RELATED APPLICATION

This application is based upon and claims the benefit of priority from Japanese Patent Application No. 2013-058942, filed on Mar. 21, 2013; the entire contents of which are incorporated herein by reference.

FIELD

Embodiments described herein relate generally to a sheet processing method, a sheet processing apparatus, and a sheet processing system.

BACKGROUND

Conventionally, sheet processing apparatuses to count and discriminate sheets, for example, have been put into practical use. The sheet processing apparatus takes in sheets which have been inserted into an insert port, and conveys the sheet to a sheet inspection device. The inspection device performs various processing to the sheet, and discriminates category, defacement degree, authentication, and so on of the sheet.

In addition, in order to process the result of counting more efficiently, the sheet processing apparatus processes a batch card on which an identification number is printed. The sheet processing apparatus correlates the count result with the identification number of the batch card.

The sheet processing apparatus has processing modes, such as, an all fitness mode, a normal mode, an all unfitness mode, and a maintenance mode. However, in a conventional sheet processing apparatus, it is necessary to stop the sheet processing apparatus, in order to switch the processing mode.

BRIEF DESCRIPTION OF THE DRAWINGS

FIGS. 11A-D are views describing batch cards according to the embodiment.

DETAILED DESCRIPTION

According to one embodiment, there is provided a sheet processing method including: taking in sheets one by one from a bundle of the sheets in which a batch card having identification information, and the sheets as mediums to be inspected are piled; conveying the sheet which has been taken in; discriminating a kind of the batch card; switching the processing mode of the sheet processing apparatus based on the kind of the batch card which has been discriminated; discriminating and counting the sheets subsequent to the batch card; storing a count result of the sheets in correlation with the identification information; and sorting the sheet into a stacker based on a discrimination result of the sheet.

Hereinafter, embodiments of a sheet processing method, a sheet processing apparatus, and a sheet processing system will be described in detail with reference to the drawings.

Figure 1:
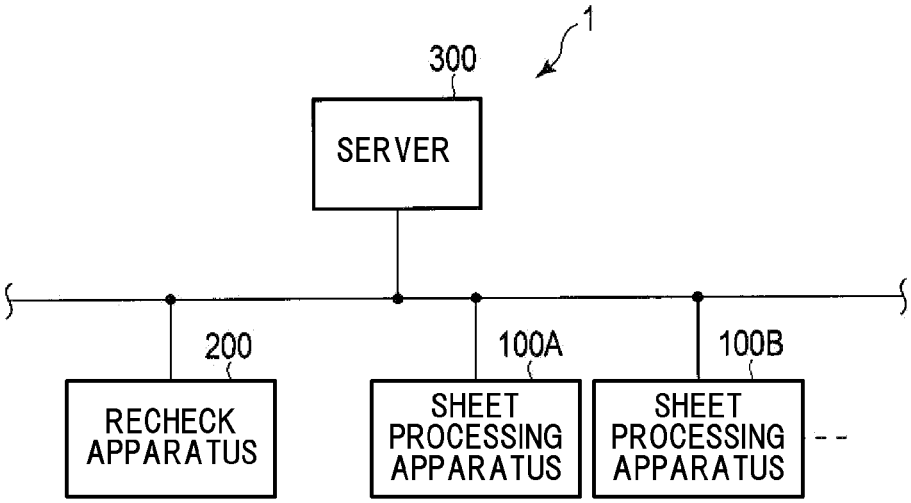
FIG. 1 is a diagram for describing a sheet processing system according to an embodiment.

FIG. 1 shows an example of a configuration of a sheet processing system 1 according to an embodiment. The sheet processing system 1 is provided with at least one or more sheet processing apparatuses 100A, 100B (hereinafter, a reference symbol 100 is used on behalf of these), a recheck apparatus 200, and a server 300. The sheet processing apparatuses 100, the recheck apparatus 200, and the server 300 are connected to each other through a network in a state capable of transmitting and receiving data.

The sheet processing apparatus 100 takes in a plurality of inserted sheets (medium to be inspected) one by one at high speed, and inspects category, fitness, authentication, and so on of the taken-in sheet. In addition, the sheet processing apparatus 100 counts the number of the sheets. Furthermore, the sheet processing apparatus 100 binds and discharges inspected reusable sheets.

In addition, the sheet processing apparatus 100 judges whether or not recheck is necessary for each sheet. The sheet processing apparatus 100 discharges a sheet which is judged as recheck is necessary as a rejected sheet.

In addition, the sheet processing apparatus 100 processes a batch card which is piled on a bundle of sheets. On the batch card, specific identification information (ID) is printed with a bar-code, a two-dimensional code, or by other method. The sheet processing apparatus 100 reads out an image of the batch card, and recognizes the identification information of the batch card.

The sheet processing apparatus 100 correlates the count result of the sheets and the identification information of the batch card as an inspection result. The sheet processing apparatus 100 transmits the inspection result to the server 300 through a transmission portion 151*c* and a LAN.

In addition, the sheet processing apparatus 100 discharges the batch card as a rejected sheet. That is, the sheet processing apparatus 100 discharges a bundle of the sheets which have been judged as recheck is necessary and the batch card as rejected sheets.

The server 300 gives an index to the inspection result transmitted from the sheet processing apparatus 100, and stores the index given inspection result in a storage medium in the server 300.

In addition, an operator who operates the sheet processing apparatus 100, and the recheck apparatus 200 inserts the rejected sheet discharged from the sheet processing apparatus 100 into the recheck apparatus 200. The recheck apparatus 200 rechecks the inserted rejected sheet.

The recheck apparatus 200 correlates the count result of the sheets and the identification information of the batch card as a recheck result. The recheck apparatus 200 transmits the correlated recheck result to the server 300.

The server 300 combines the recheck result transmitted from the recheck apparatus 200 and the inspection result transmitted from the sheet processing apparatus 100, and stores the combined inspection result in the storage medium in the server 300. For example, the server 300 adds the recheck result to the inspection result including the identification information which coincides with the identification information included in the recheck result.

Figure 2:
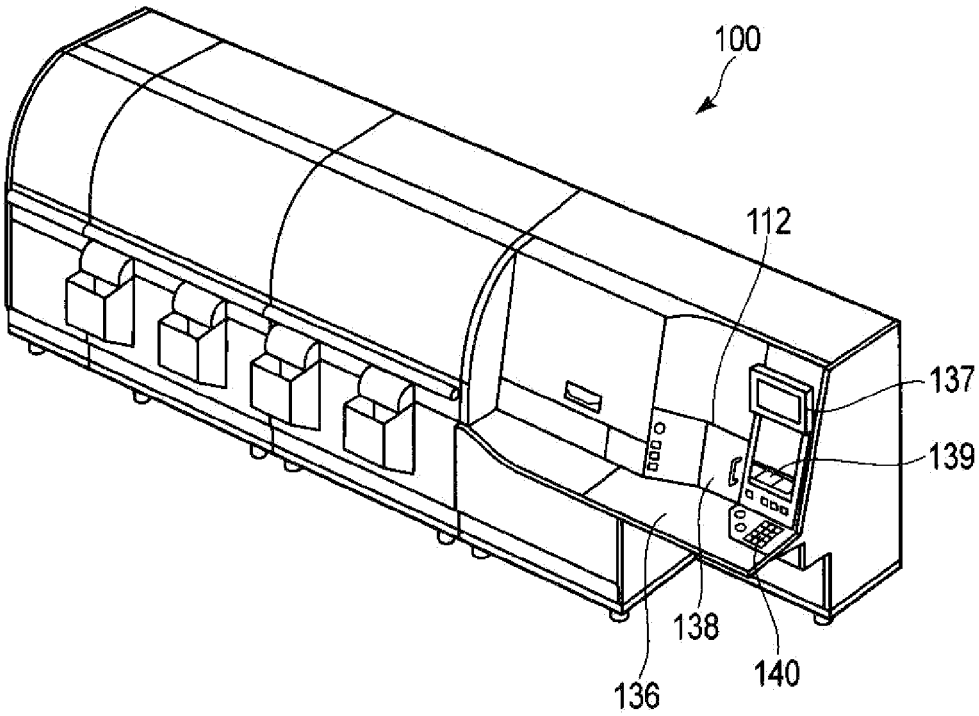
FIG. 2 is a view for describing the sheet processing apparatus according to the embodiment.

FIG. 2 shows an appearance of the sheet processing apparatus 100 according to the embodiment. As shown in FIG. 2, the sheet processing apparatus 100 is provided with an insert port 112, an operation portion 136, an operation/display portion 137, a door 138, a take-out port 139, and a keyboard 140.

The insert port 112 is a configuration so as to insert a sheet P. The insert port 112 collectively receives sheets P in a stacked state. In addition, as described above, a batch card is piled on a bundle of the sheets P.

The operation portion 136 accepts various operation inputs by an operator. The operation/display portion 137 displays various operation guides, processing results, and so on to the operator. In addition, the operation/display portion 137 may be configured as a touch panel. In this case, the sheet processing apparatus 100 detects various operation inputs, based on a button displayed on the operation/display portion 137, and an operation to the operation/display portion 137 by the operator.

The door 138 is a door so as to open and close an input port of the insert port 112. The take-out port 139 is a configuration so as to take out the sheet P from a stacker to stack a sheet P which has been judged as non-recirculatable by the sheet processing apparatus 100. The keyboard 140 functions as an input portion to accept various operation inputs by an operator.

Figure 3:
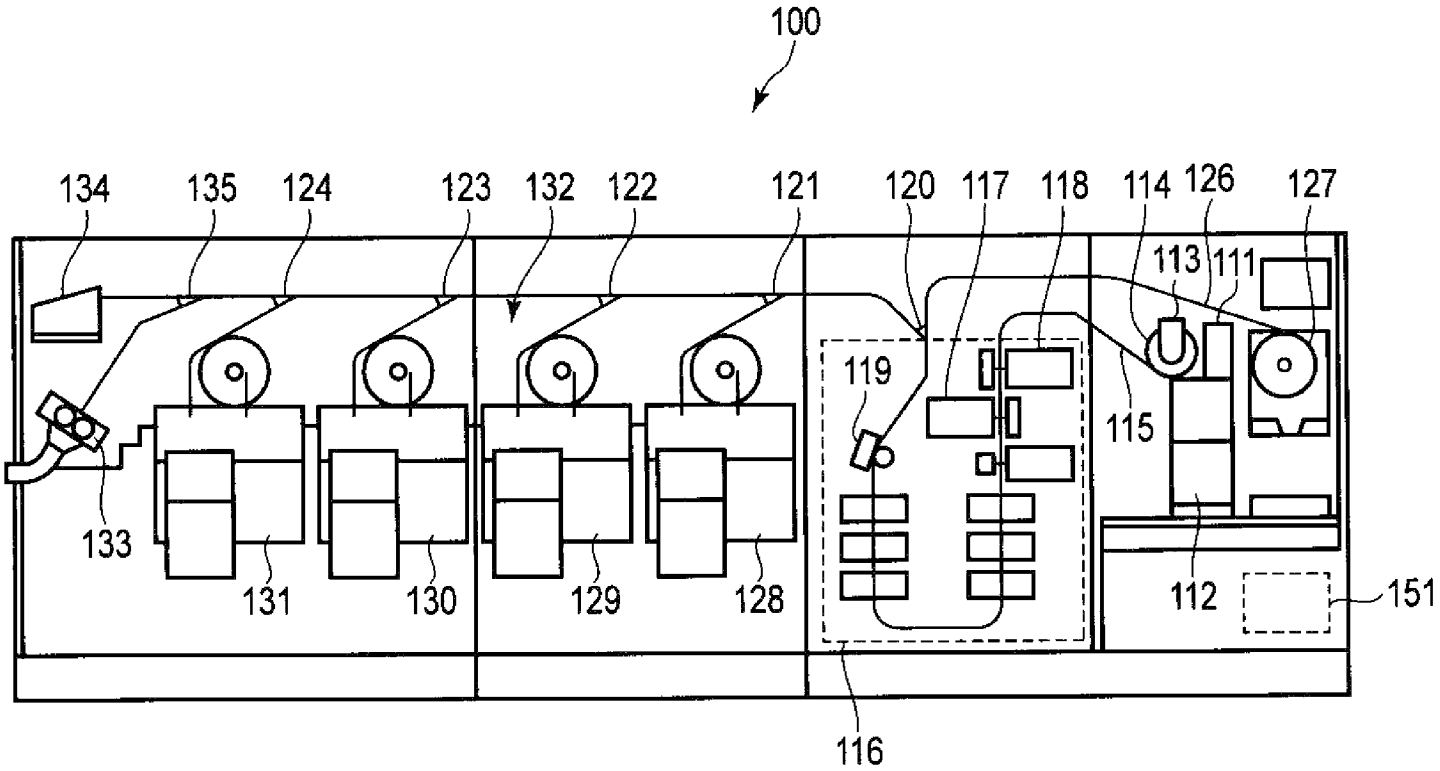
FIG. 3 is a view for describing the sheet processing apparatus according to the embodiment.

FIG. 3 shows a configuration example of the sheet processing apparatus 100 of FIG. 2. The sheet processing apparatus 100 is provided with a batch card detector 111, the insert port 112, a take in portion 113, a suction roller 114, a conveying route 115, an inspection portion 116, gates 120 to 125, a rejection sheet conveying route 126, a rejection sheet stacker 127, stack/band portions 128 to 131, a cutting portion 133, and a stacker 134. In addition, the sheet processing apparatus 100 is provided with a main controller 151. The main controller 151 integrally controls operation of the respective portions of the sheet processing apparatus 100.

The take in portion 113 is provided above the insert port 112. The take in portion 113 is provided with the suction roller 114. The suction roller 114 is provided so as to contact a sheet P set in the insert port 112 at the upper end in the stacking direction. That is, the suction roller 114 rotates, to take sheets P set in the insert port 112 into the apparatus one by one from the upper end in the stacking direction. The suction roller 114 functions so as to take out one sheet P for each one rotation, for example. By this means, the suction roller 114 takes out the sheets P with a constant pitch. The sheet P which has been taken in by the suction roller 114 is introduced into the conveying route 115. In addition, the suction roller 114 may be a configuration provided with a suction rotor which sucks the surface of a sheet using suction force by a vacuum pump, for example, and thereby takes out the sheet.

The batch card detector 111 is a sensor to discriminate the kind of a batch card. The batch card detector 111 is provided with a sensor to recognize a color, for example. For example, the batch card detector 111 recognizes colors, such as "red", "blue", "green", "yellow", and "white". The batch card detector 111 detects the color of the sheet P, before the suction roller 114 takes in the sheet P. The batch card detector 111 supplies the detection result to the main controller 151. By this means, the sheet processing apparatus 100 discriminates whether or not the sheet P is a batch card, and the kind of the batch card.

The conveying route 115 conveys the sheet P to the respective portions in the sheet processing apparatus 100. The conveying route 115 is provided with a conveyor belt and a drive pulley and so on not shown. The conveying route 115 makes the conveyor belt to be operated by a drive motor and the drive pulley not shown. The conveying route 115 conveys the sheet P which has been taken in by the suction roller 114 by the conveyor belt at a constant speed. In addition, the description will be made, assuming that in the conveying route 115, a side near to the take in portion 113 is an upstream side, and a side near to the stacker 134 is a downstream side.

The inspection portion 116 is provided on the conveying route 115 extending from the take in portion 113. The inspection portion 116 is provided with image readers 117 and 118, and a thickness inspection portion 119. The inspection portion 116 detects optical characteristic information, mechanical characteristic, and magnetic characteristic information of the sheet P. By this means, the sheet processing apparatus 100 detects the kind (category), a defacement degree, authentication, and so on of the sheet P.

The image readers 117 and 118 are provided to face each other across the conveying route 115. The image readers 117 and 118 read out images of the both surfaces of the sheet P conveyed on the conveying route 115, respectively. Each of the image readers 117 and 118 is provided with a configuration in which a plurality of light receiving elements, such as Charged Coupled Devices (CCD) or Complementary Metal Oxide Semiconductors (CMOS) are arranged, and an optical system. The light receiving element converts the received light into an electrical signal, that is an image. The optical system is provided with a configuration, such as a lens or a light guide member, which receives light and makes the received light to be imaged on the light receiving element.

The sheet processing apparatus 100 obtains pattern images of the surface and the rear face of the sheet P based on the images imaged by the image readers 117 and 118. In addition, the image readers 117 and 118 obtain an image (batch card image) including identification information printed on the batch card, and transmits the obtained image to the main controller 151.

The image readers 117 and 118 temporarily store the read images in a memory not shown inside the inspection portion 116. The sheet processing apparatus 100 displays the images stored in this memory on the operation/display portion 137 in accordance with an operation input.

The thickness inspection portion 119 inspects a thickness of the sheet P conveyed on the conveying route 115. For example, when the detected thickness is not less than a specified value, the sheet processing apparatus 100 detects two-sheet taking of the sheets P.

In addition, the inspection portion 116 is provided with a magnetism inspection portion and so on not shown. The magnetism inspection portion detects magnetic characteristic information of a sheet P. In addition, the inspection portion 116 is provided with a fluorescence inspection portion and so on. The fluorescence inspection portion detects a florescent image of a sheet P.

The main controller 151 performs various discrimination, based on the detection results of the imager readers 117 and 118, the thickness inspection portion 119, the magnetic sensor, and so on. For example, the main controller 151 determines a denomination or a category of a sheet P.

In addition, the main controller 151 determines authentication of a sheet P. That is, the main controller 151 determines whether the sheet P is a genuine sheet, or a counterfeit sheet.

In addition the main controller 151 detects fitness of a sheet P. That is, the main controller 151 determines whether the sheet P is a fit sheet which can be recirculated or an unfit sheet which can not be recirculated.

In addition, the main controller 151 determines whether or not a sheet P is a rejected sheet. That is, the main controller 151 determines a sheet P determined as a counterfeit sheet, or sheets whose overlapping has been detected by the thickness inspection portion 119, or a sheet P whose discrimination has been impossible, as a rejected sheet. For example, the main controller 151 determines a batch card as a rejected sheet.

In addition, the main controller 151 determines sheets P in which short pitch has occurred, as rejected sheets. Here, when the short pitch meaning that the gap between a preceding sheet P and a succeeding sheet P is short in the conveying route occurs, detection by the respective detectors can not be surely performed.

The sheet processing apparatus 100 conveys a sheet P determined as a fit sheet to one of the stack/band portions 128 to 131. In addition, the sheet processing apparatus 100 conveys a sheet P determined as an unfit sheet to the cutting portion 133. The cutting portion 133 cuts the conveyed unfit sheet. In addition, the sheet processing apparatus 100 may convey and stack an unfit sheet in the stacker 134. For example, the stacker 134 seals the unfit sheets each time the number of the stacked unfit sheets reaches 100, for example.

The sheet processing apparatus 100 conveys a sheet P determined as an rejected sheet to the rejection sheet stacker 127. The rejected sheet includes a conveyance abnormality sheet such as two-sheet taking sheets, a defective sheet in which fold or break is present, and a discrimination impossible sheet such as a sheet of non-applicable category or a counterfeit sheet. In addition the sheet processing apparatus 100 conveys a batch card inserted between a sheet P and a sheet P to the rejection sheet stacker 127 as a rejected sheet.

The gates 120 to 125 are arranged in order on the conveying route 115 at the downstream side of the inspection portion 116. Each of the gates 120 to 125 is controlled by the main controller 151. The main controller 151 controls the operation of each of the gates 120 to 125 based on the inspection result by the inspection portion 116. By this means, the main controller 151 controls so as to convey the sheet P conveyed in the conveying route 115 to a prescribed processing portion.

The gate 120 arranged just behind the inspection portion 116 branches the conveying route 115 to the rejection sheet conveying route 126. That is, the gate 120 is switched so that a rejected sheet determined as not a genuine sheet as a result of the inspection by the inspection portion 116, a non-inspectable sheet which can not be inspected by the inspection portion 116, or the like is conveyed to the rejection sheet conveying route 126.

At the end portion of the rejection sheet conveying route 126, the rejection sheet stacker (rejection portion) 127 is provided. The rejection sheet stacker 127 stacks the rejected sheet, and the non-inspectable sheet as described above with a posture in which the sheet is taken out by the take in portion 113. The sheet P stacked in the rejection sheet stacker 127 is taken out from the take-out port 139.

In addition, at fronts of positions which are branched by the gates 121 to 124, the stack/band portions 128 to 131 (referred to as stack/band portions 132, as a whole) are respectively provided. In the stack/band portions 132, sheets P determined as recirculatable are sorted and stacked for each category and each front and back. The stack/band portion 132 binds and houses the stacked sheets P for each prescribed number of sheets.

At the front of a position which is branched by the gate 125, the cutting portion 133 is arranged. The cutting portion 133 cuts and houses a sheet P. The sheet P conveyed to the gate 125 is a regular sheet P, and also a sheet P (unfit sheet) determined as non-recirculatable.

In addition, at the front of the other conveying route which is branched by the gate 125, the stacker 134 is arranged. The main controller 151 controls the gate 125 so as to convey the sheet P to the cutting portion 133, when an unfit sheet cutting mode is selected. In addition, the main controller 151 controls the gate 125 so as to convey the sheet P to the stacker 134, when the unfit sheet cutting mode is not selected.

Furthermore, an operator operates the operation portion 136, the operation/display portion 137, the keyboard 140, and so on, and thereby can optionally set the kind (category) of the sheet P processed by the sheet processing apparatus 100.

Figure 4:
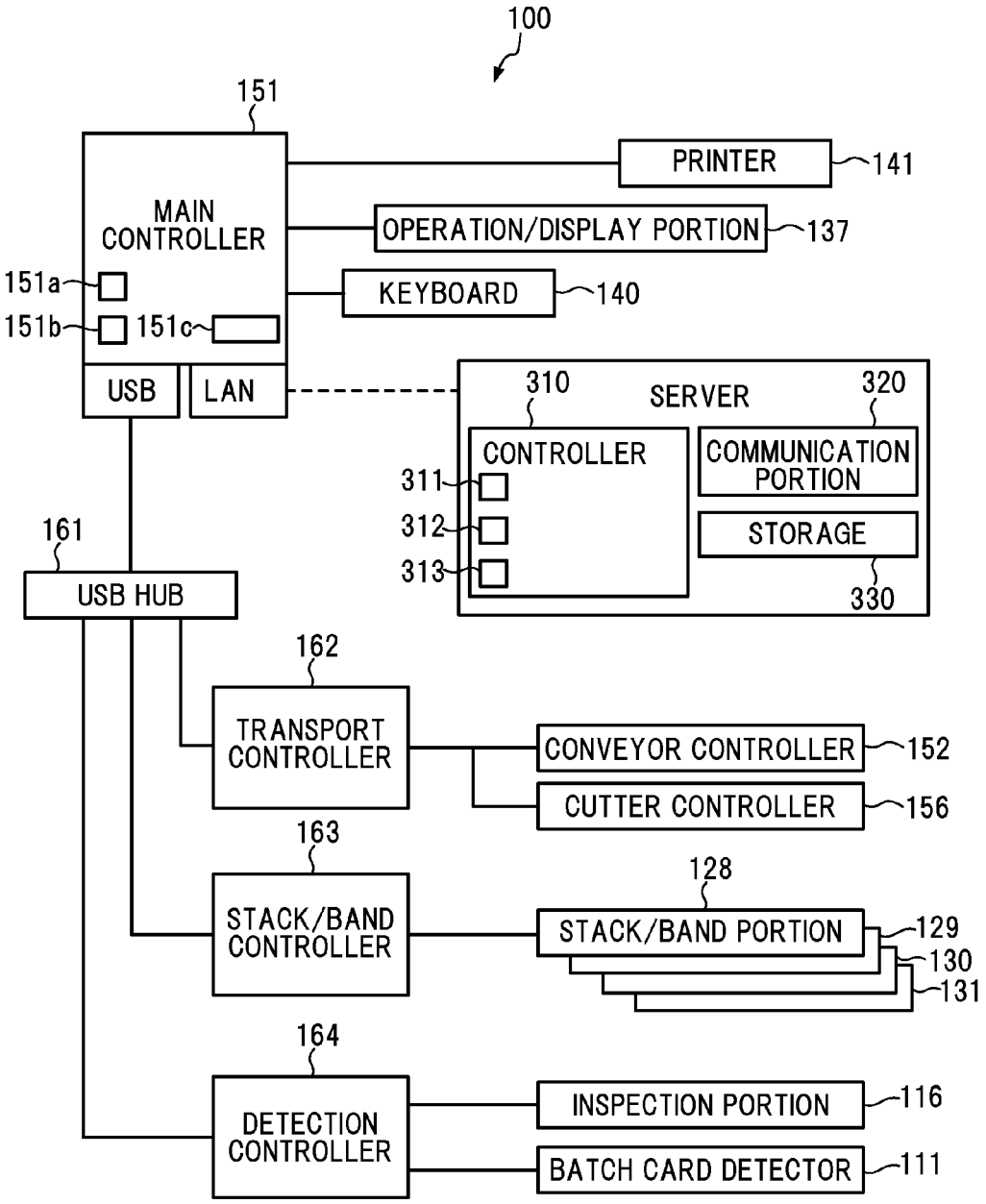
FIG. 4 is a diagram for describing the sheet processing apparatus according to the embodiment.

FIG. 4 shows a configuration example of a control system of the sheet processing apparatus 100 of FIG. 2 and FIG. 3. The sheet processing apparatus 100 is provided with the main controller 151, the batch card detector 111, the inspection portion 116, a conveyor controller 152, a cutter controller 156, the operation/display portion 137, the keyboard 140, and so on. In addition, the sheet processing apparatus 100 is provided with a printer 141, a USB hub 161, a transport controller 162, a stack/band controller 163, a detection controller 164, and so on.

The main controller 151 administers the overall control of the sheet processing apparatus 100. The main controller 151 can be realized by a part of a PC (personal computer) and so on, for example.

The main controller 151 controls the conveyor controller 152 and the cutter controller 156, based on the operation inputted by the operation/display portion 137, and the inspection result of the inspection portion 116. In addition, the main controller 151 switches the processing mode of the sheet processing apparatus 100, based on the detection result by the batch card detector 111. In addition, the main controller 151 can output the inspection result and so on as a document by the printer 141. Furthermore, the main controller 151 transmits the inspection result to the server 300 through a network such as a LAN.

In addition, the USB hub 161 is connected to the main controller 151. In addition, the transport controller 162, the stack/band controller 163, the detection controller 164, and so on are connected to the USB hub 161.

The main controller 151 controls the operation of the conveyor controller 152, the cutter controller 156, the take in portion 113, and so on through the transport controller 162. In addition, the main controller 151 controls the operation of the stack/band portions 128 to 131 through the stack/band controller 163. In addition the main controller 151 controls the operation of the respective detection devices of the inspection portion 116 and the batch card detector 111.

For example, an operator inputs threshold values for respective processing items in the various determination for the sheet P to be processed, and a processing method and so on, by the operation/display portion 137 or the keyboard 140.

The batch card detector 111 detects a color of the sheet P which has been taken in, as described above. The inspection portion 116 is provided with the image readers 117 and 118, the thickness inspection portion 119, and so on, as described above.

The conveyor controller 152 controls the take in portion 113, the conveying route 115, the rejection sheet conveying route 126, and the gates 120 to 125, based on the control of the main controller 151. By this means, the conveyor controller 152 controls the taking-in and the conveying of the sheet P. In addition, the conveyor controller 152 performs sorting processing to sort the determined sheet P for each category. That is, the conveyor controller 152 functions as a sorting processing portion.

For example, the conveyor controller 152 controls the gates 120 to 125 so as to convey the sheet P determined as an unfit sheet to the cutting portion 133, or the stacker 134. In addition, the conveyor controller 152 controls the gates 120 to 125 so as to convey the sheet P determined as a rejected sheet, and the batch card to the rejection sheet stacker 127.

The stack/band controller 163 controls the rejection sheet stacker 127, and the stack/band portions 128 to 131 based on the control of the main controller 151. By this means, the stack/band controller 163 performs the control of the stacking and binding of the sheets P.

The cutter controller 156 controls the operation of the cutting portion 133 based on the control of the main controller 151. By this means, the cutting portion 133 cuts the conveyed sheet P.

In addition, the main controller 151 recognizes the identification information of the batch card, based on the image of the identification information of the batch card obtained by the image readers 117 and 118.

In addition, the main controller 151 correlates the count result of the sheets P conveyed to the stack/band portion 132 or the cutting portion 133 with the identification information of the batch card, and stores them as an inspection result. In addition, the main controller 151 transmits the inspection result to the server 300.

In addition, the main controller 151 is provided with a memory 151*a* which previously stores threshold values for the inspection items by the respective inspection devices of the inspection portion 116. The main controller 151 compares the detection values detected by the respective inspection devices of the inspection portion 116 with the threshold values stored in the memory 151*a*, and determines the category, authentication, fitness of the sheet P, and whether or not the sheet P is a rejected sheet, and so on, based on the comparison result.

In addition, the threshold values stored in the memory 151*a* may be changed, based on inputs to the operation portion 136, the operation/display portion 137, the keyboard 140, and so on.

In addition, the main controller 151 is provided with a memory 151*b* to store an inspection result in which the count result of the sheets P and the identification information of the batch card are correlated.

In addition, the sheet processing apparatus 100 has processing modes, such as an all fitness mode, a normal mode, an all unfitness mode, and a maintenance mode. When the processing is performed in the normal mode, the sheet processing apparatus 100 determines fitness of the sheet P. When the processing is performed in the all fitness mode, the sheet processing apparatus 100 determines that the all sheets P are fit sheets. In addition, when the processing is performed in the all unfitness mode, the sheet processing apparatus 100 determines that the all sheets P are unfit sheets. When the processing is performed in the maintenance mode, the sheet processing apparatus 100 calibrates the operation of the respective configurations of the inspection portion 116, based on the detection result detected from the sheet P.

In addition, as shown in FIG. 4, the server 300 is provided with a controller 310, a communication portion 320, and a storage 330.

The controller 310 functions as a controller to control the operation of the respective portions of the server 300. The controller 310 is provided with a CPU 311, a ROM 312, a RAM 312, and so on. The controller 310 performs various processing based on the information inputted through the communication portion 320.

The CPU 311 is provided with arithmetic elements and so on to execute various arithmetic processings. The CPU 311 executes a program stored in the ROM 312, to realize various functions. The ROM 312 stores a program so as to control the server 300, programs so as to realize various functions, and so on. The RAM 313 functions as a work memory of the CPU 311. That is, the RAM 313 stores the arithmetic result of the CPU 311, data read out by the CPU 311, and so on.

The communication portion 320 performs communication with other device on a network such as the Internet by the LAN. By this means, the server 300 communicates with the sheet processing apparatus 100 installed on the network.

The storage 330 is provided with a hard disk drive (HDD), a solid state drive (SSD), or other storage device. The controller 310 makes the various information received through the communication portion 320 to be stored in the storage 330.

As described above, the server 300 stores the inspection result transmitted from the sheet processing apparatus 100 in the storage 330. In addition, the server 300 further combines the recheck result transmitted from the recheck apparatus 200 with the inspection result transmitted from the sheet processing apparatus 100, and stores the combined inspection result in the storage 330.

Figure 5:
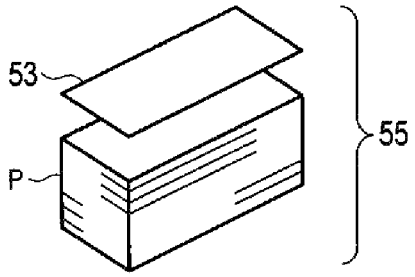
FIG. 5 is a view for describing the sheet processing apparatus according to the embodiment.
Figure 6A:
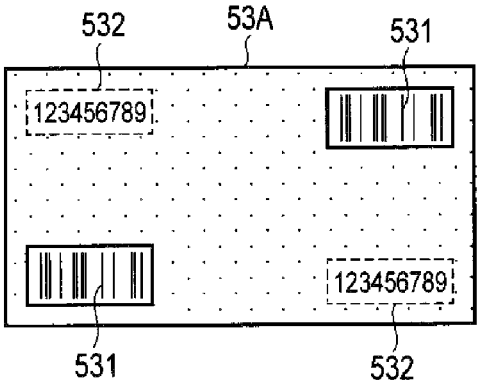
FIGS. 6A-D are views describing batch cards according to the embodiment.
Figure 6B:
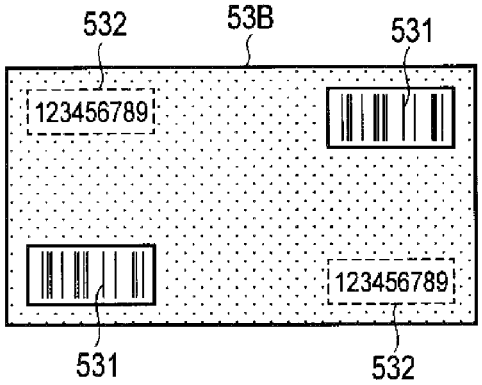
Figure 6C:
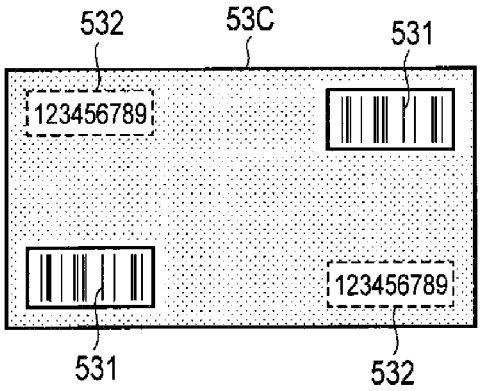
Figure 6D:
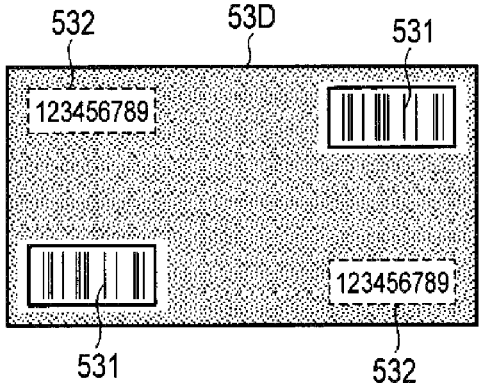
Figure 7:
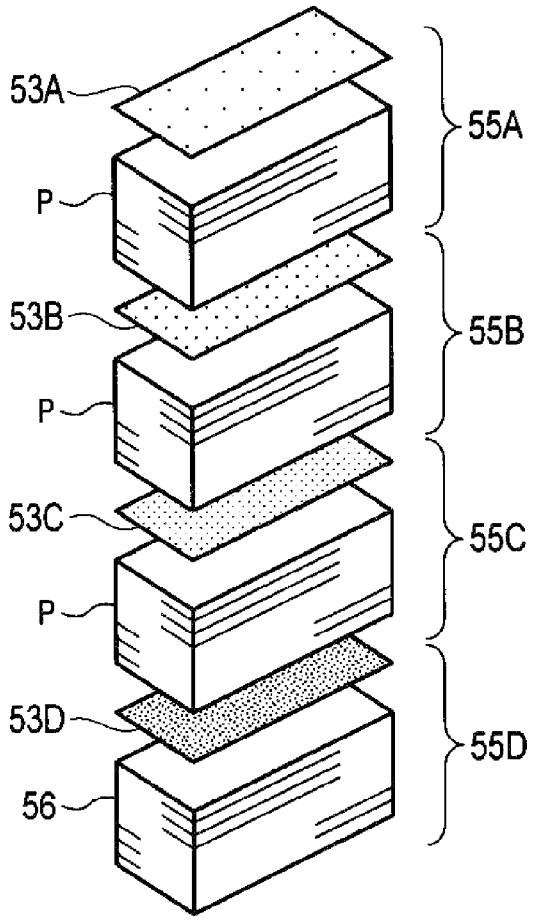
FIG. 7 is a view for describing the sheet processing apparatus according to the embodiment.
Figure 8:
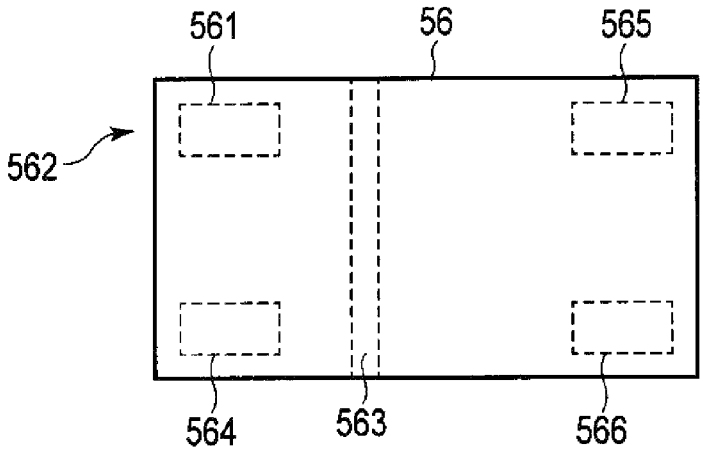
FIG. 8 is a view for describing a maintenance card according to the embodiment.
Figure 9A:
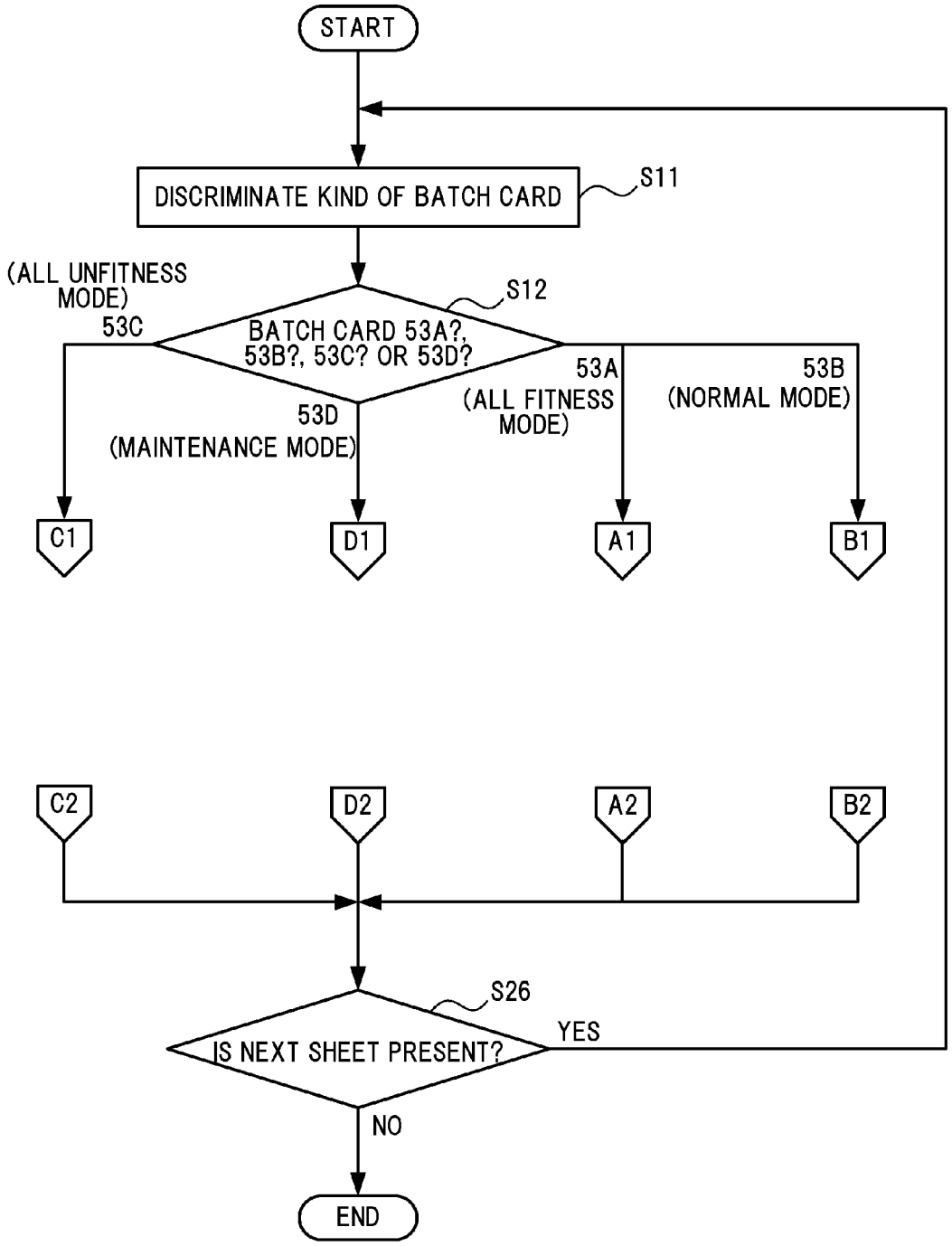
FIGS. 9A-E are diagrams describing the sheet processing apparatus according to the embodiment.
Figure 9B:
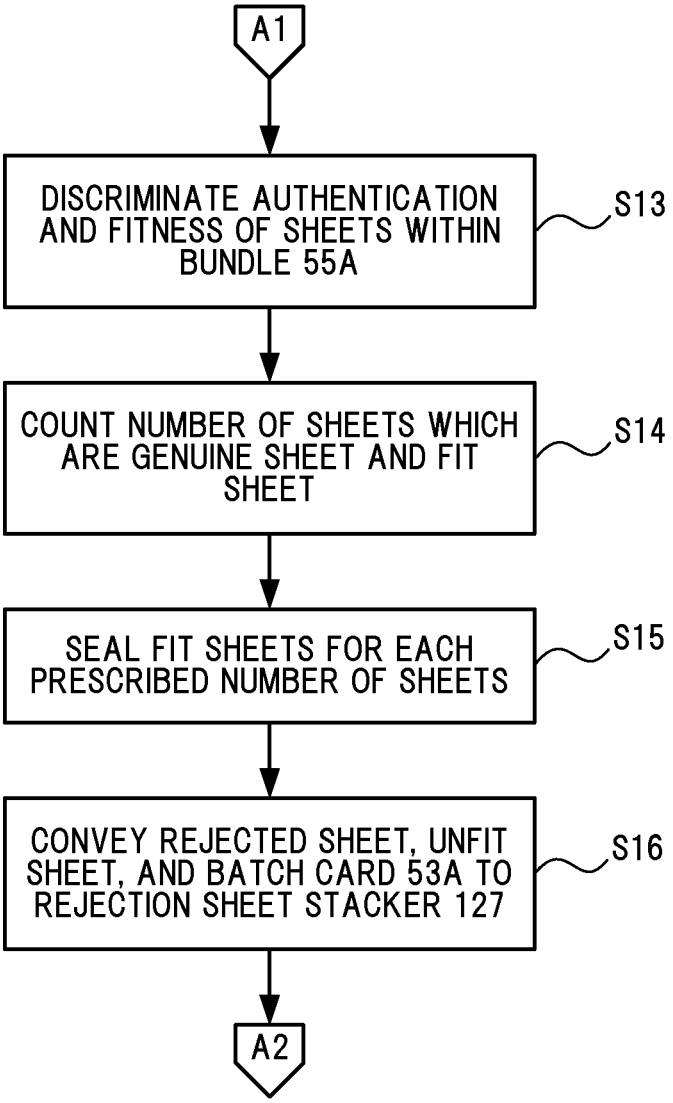
Figure 9C:
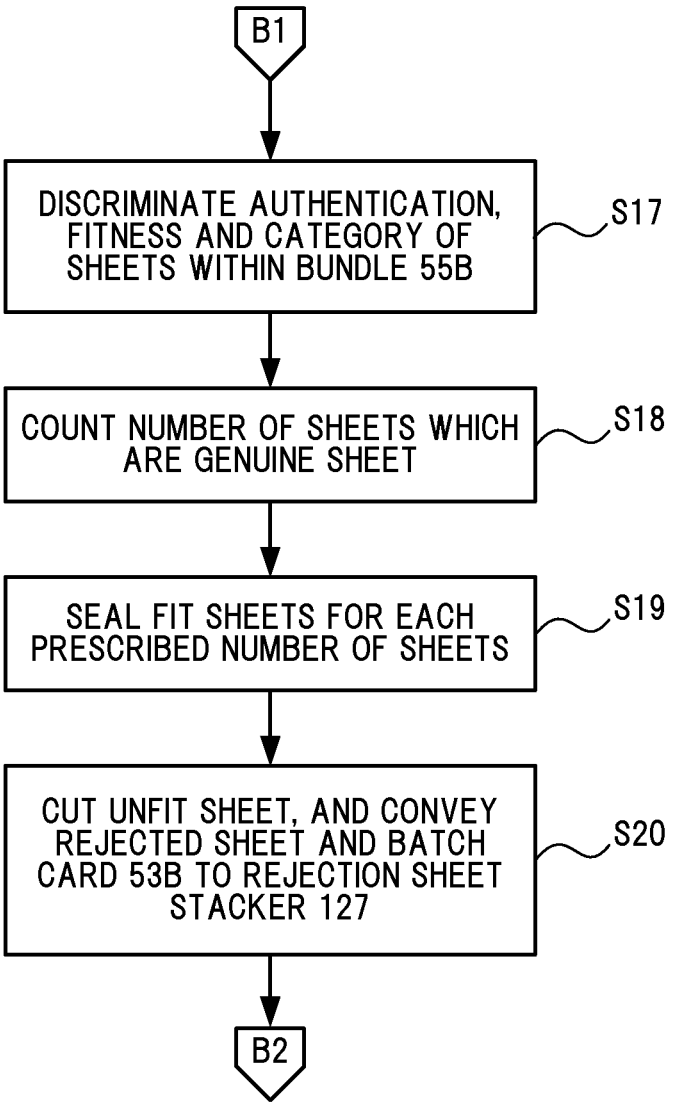
Figure 9D:
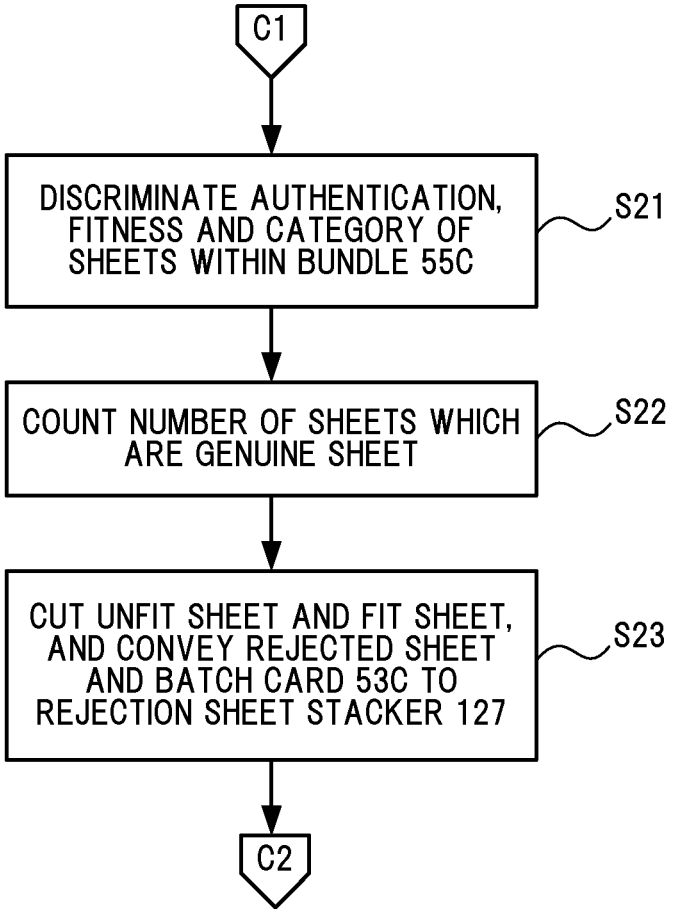
Figure 9E:
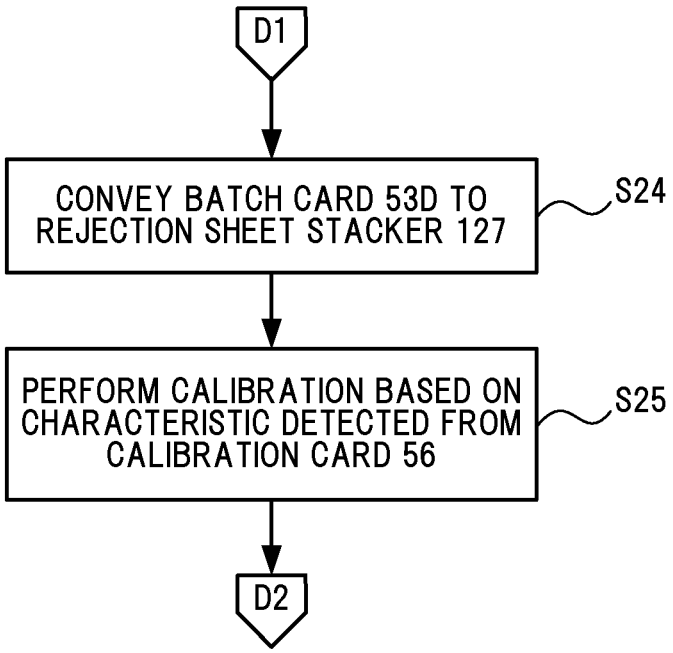

FIG. 5 to FIG. 8 show examples of a batch card, a bundle of sheets P, and a calibration card for maintenance (calibration card). FIG. 5 shows an example of a bundle 55 of the sheets P. FIG. 6 shows an example of batch cards 53. FIG. 7 shows an example of a plurality of the bundles 55. FIG. 8 shows an example of the calibration card. As shown in FIG. 5, the bundle 55 of the sheets P is one in which a prescribed number (1000, for example) of the sheets P and the batch card 53 are piled. For example, the bundle 55 of the sheets P is formed by piling and binding the batch card 53 on the plurality of the sheets P. That is, in the bundle 55 of the sheets P, the batch card 53 and a prescribed number (1000, for example) of the sheets P are bound in this order.

The batch card 53 is a sheet which is formed with the same external dimension as the sheet P, or with an external dimension larger than the sheet P, and in which printing showing identification information is performed on a surface or a rear face thereof.

As shown in FIGS. 6A-D, as the batch cards 53, there are a plurality of kinds in which the colors of the sheet surfaces are different, such as, a batch card 53A with a green sheet surface, a batch card 53B with a yellow sheet surface, a batch card 53C with a red sheet surface, and a batch card 53D with a blue sheet surface. Furthermore, the batch card 53A to the batch card 53D are referred to as the batch cards 53, as a whole. Each of the batch cards 53 has printing such as a bar-code 531 in which identification information is encoded, and a character string 532 indicating the identification information. In addition, the bar-code 531, and the character string 532 and so on are also printed on the rear face of each of the batch cards 53.

The main controller 151 of the sheet processing apparatus 100 analyzes the bar-code 531 or the character string 532 of the batch card image, and thereby obtains the identification information of the batch card 53. Furthermore, the identification information of the batch card 53 is printed not only with the bar-code, but also may be printed with a two-dimensional code, or may be encoded and printed by other method. Furthermore, a pattern by which the card can be discriminated as the batch card 53 by the sheet processing apparatus 100 or the recheck apparatus 200 is printed on the batch card 53.

The sheet processing apparatus 100 discriminates whether or not the taken-in sheet P is a batch card. Furthermore, the sheet processing apparatus 100 discriminates the kind of the batch card by the batch card detector 111. That is, the sheet processing apparatus 100 discriminates whether the sheet is the batch card 53A, 53B, 53C, 53D, or the sheet P to be inspected, before taking in the sheet.

For example, the sheet processing apparatus 100, when the color of the taken-in sheet is green, recognizes to have taken in the batch card 53A. In addition, the sheet processing apparatus 100, when the color of the taken-in sheet is yellow, recognizes to have taken in the batch card 53B. The sheet processing apparatus 100, when the color of the taken-in sheet is red, recognizes to have taken in the batch card 53C. The sheet processing apparatus 100, when the color of the taken-in sheet is blue, recognizes to have taken in the batch card 53D.

When recognizing to have taken in the batch card 53A, the sheet processing apparatus 100 processes the sheet by the all fitness mode. In addition, when recognizing to have taken in the batch card 53B, the sheet processing apparatus 100 processes the sheet by the normal mode. In addition, when recognizing to have taken in the batch card 53C, the sheet processing apparatus 100 processes the sheet by the all unfitness mode. In addition, when recognizing to have taken in the batch card 53D, the sheet processing apparatus 100 processes the sheet by the maintenance mode.

FIG. 7 shows an example of the bundles 55 of the sheets to be inserted into the sheet processing apparatus 100. A bundle 55A is a bundle of the sheets P on which the batch card 53A with a green sheet surface is piled. A bundle 55B is a bundle of the sheets P on which the batch card 53B with a yellow sheet surface is piled. A bundle 55C is a bundle of the sheets P on which the batch card 53C with a red sheet surface is piled. A bundle 55D is a bundle of calibration cards 56 on which the batch card 53D with a blue sheet surface is piled.

When detecting the batch card 53A, the sheet processing apparatus 100 processes the sheet by the all fitness mode. That is, the sheet processing apparatus 100 processes the bundle 55A by the all fitness mode. In this case, the sheet processing apparatus 100 discriminates the authentication and fitness of the sheets P in the bundle 55A, and counts the number of the sheets P which are a genuine sheet and a fit sheet. In addition, when operating in the all fitness mode, the sheet processing apparatus 100 seals the fit sheets for a prescribed number of sheets, and rejects a rejected sheet, an unfit sheet, and the batch card 53A.

In addition, when recognizing to have taken in the batch card 53B, the sheet processing apparatus 100 processes the sheet by the normal mode. That is, the sheet processing apparatus 100 processes the bundle 55B by the normal mode. In this case, the sheet processing apparatus 100 discriminates the authentication, fitness and category of the sheets P in the bundle 55B, and counts the number of the sheets P which are a genuine sheet. Furthermore, when operating in the normal mode, the sheet processing apparatus 100 seals the fit sheets for a prescribed number of sheets, cuts an unfit sheet, and rejects a rejected sheet and the batch card 53B.

In addition, when recognizing to have taken in the batch card 53C, the sheet processing apparatus 100 processes the sheet by the all unfitness mode. That is, the sheet processing apparatus 100 processes the bundle 55C by the all unfitness mode. In this case, the sheet processing apparatus 100 discriminates the authentication, fitness, and category of the sheets P in the bundle 55C, and counts the number of the sheets P which are a genuine sheet.

In addition, when operating in the all unfitness mode, the sheet processing apparatus 100 cuts a fit sheet and an unfit sheet, and rejects a rejected sheet and the batch card 53C.

When recognizing to have taken in the batch card 53D, the sheet processing apparatus 100 processes the sheet by the maintenance mode. That is, the sheet processing apparatus 100 processes the bundle 55D by the maintenance mode. In this case, the sheet processing apparatus 100 calibrates the operation of the respective configurations of the modules of the inspection portion 116, using the calibration cards 56 in the bundle 55D. Furthermore, when operating in the maintenance mode, the sheet processing apparatus 100 rejects the batch card 53D and the calibration cards 56 in the bundle 55D.

FIG. 8 shows an example of the calibration card 56. The calibration card 56 is a sheet which is formed with the same external dimension as the sheet P, or with an external dimension larger than the sheet P, and in which security used for various determinations is performed on a surface or a rear face thereof.

As shown in FIG. 8, the calibration card 56 has security items, such as a white reference 561, a thickness reference 562, a magnetism reference 563, a fluorescence reference 564, an RGB ratio reference 565, and a focusing pattern 566.

The modules of the inspection portion 116 of the sheet processing apparatus 100 perform various calibrations based on the detection result of the security items of the calibration card 56, respectively. For example, the image readers 117 and 118 of the inspection portion 116 calibrate so that white balance, lightness, and so on become proper values at the time of obtaining the image, based on the white reference 561 and the RGB ratio reference 565 of the calibration card 56.

In addition, the image readers 117 and 118 of the inspection portion 116 calibrate a focus at the time of obtaining the image, based on the focusing pattern 566 of the calibration card 56, for example.

In addition, the thickness inspection portion 119 of the inspection portion 116 calibrates the reference at the time of detecting the thickness of the sheet P, based on the thickness reference 562 of the calibration card 56, for example.

In addition, the magnetism inspection portion of the inspection portion 116 calibrates the reference at the time of detecting magnetism from the sheet P, based on the magnetism reference 563 of the calibration card 56.

In addition, the fluorescence inspection portion of the inspection portion 116 calibrates the reference at the time of obtaining a fluorescent image from the sheet P, based on the fluorescence reference 564 of the calibration card 56.

When operating in the maintenance mode, the sheet processing apparatus 100 integrally performs calibration using a plurality of the calibration cards 56.

FIGS. 9A-E show an example of a processing of the sheet processing apparatus 100. An operator starts up the sheet processing apparatus 100, and performs various settings. The operator sets the bundle 55 into the insert port 112 of the sheet processing apparatus 100, and makes the processing to be started by the operation/display portion 137. Furthermore, the sheet processing apparatus 100 continuously processes a plurality of the bundles 55 partitioned by batch cards.

The batch card detector 111 discriminates the kind of the batch card 53 out of the sheets P which have been taken in one by one from the insert port 112 (step S11). That is, the sheet processing apparatus 100 discriminates whether the batch card 53 is the batch card 53A, 53B, 53C, or 53D.

The sheet processing apparatus 100 switches the processing mode based on the discriminated kind of the batch card 53 (step S12).

That is, when recognizing that the batch card 53 is the batch card 53A, the sheet processing apparatus 100 switches the processing mode to the all fitness mode. When switched to the all fitness mode, the sheet processing apparatus 100 discriminates the authentication and fitness of the sheets P in the bundle 55A (step S13). The sheet processing apparatus 100 counts the number of the sheets P which are genuine sheets and fit sheets (step S14). In addition, when operating in the all fitness mode, the sheet processing apparatus 100 seals the fit sheets for each predetermined number of the sheets (step 15). The sheet processing apparatus 100 conveys the rejected sheet, the unfit sheet, and the batch card 53A to the rejection sheet stacker 127 (step S16), and the processing transfers to the processing of a step S26.

In addition, when recognizing that the batch card 53 is the batch card 53B, the sheet processing apparatus 100 switches the processing mode to the normal mode. When switched to the normal mode, the sheet processing apparatus 100 discriminates the authentication, fitness, and category of the sheets P in the bundle 55B (step S17). The sheet processing apparatus 100 counts the number of the sheets P which are genuine sheets (step S18). When operating in the normal mode, the sheet processing apparatus 100 seals the fit sheets for each predetermined number of the sheets (step S19). The sheet processing apparatus 100 cuts the unfit sheet, and conveys the rejected sheet and the batch card 53B to the rejection sheet stacker 127 (step S20), and the processing transfers to the processing of the step S26.

In addition, when recognizing that the batch card 53 is the batch card 53C, the sheet processing apparatus 100 switches the processing mode to the all unfitness mode. When switched to the all unfitness mode, the sheet processing apparatus 100 discriminates the authentication, fitness, and category of the sheets P in the bundle 55C (step S21). The sheet processing apparatus 100 counts the number of the sheets P which are genuine sheets (step S22). When operating in the all unfitness mode, the sheet processing apparatus 100 cuts the fit sheet and the unfit sheet, and conveys the rejected sheet and the batch card 53C to the rejection sheet stacker 127 (step S23), and the processing transfers to the processing of the step S26.

In addition, when recognizing that the batch card 53 is the batch card 53D, the sheet processing apparatus 100 switches the processing mode to the maintenance mode. When the processing mode is the maintenance mode, the sheet processing apparatus 100 comes to process the batch card 53D or the calibration card 56. When the taken-in sheet is the batch card 53D, the sheet processing apparatus 100 conveys the batch card 53D to the rejection sheet stacker 127 (step S24), and the processing transfers to the following processing of the calibration card 56.

In addition, when the taken-in sheet is the calibration card 56, the sheet processing apparatus 100 performs calibration based on the characteristic detected from the calibration card 56 (step S25), and the processing transfers to the processing of the step S26.

In addition, when judging that the subsequent sheet P is not present in the step S26, the sheet processing apparatus 100 correlates the identification information read out from the batch card 53 with the count result of the sheets P, and obtains the inspection result. The main controller 151 of the sheet processing apparatus 100 correlates the count result with the identification information of the batch card as an inspection result, and stores the inspection result in the memory 151*b*. In addition, the sheet processing apparatus 100 transmits the inspection result to the server 300.

Furthermore, an operator confirms the rejected sheet bundle, and confirms the sheets P in the rejected sheet bundle. The operator confirms the number of the genuine sheets in the rejected sheet bundle, and inputs the number of the genuine sheets by the operation/display portion 137. By this means, the sheet processing apparatus 100 obtains a count result that is a sum of the number of the sheets P which is automatically counted, and the number of the sheets P which the operator has confirmed.

Furthermore, the sheet processing apparatus 100 correlates the inputted number of the sheets with the identification information of the batch card 53, and transmits the correlated result to the server 300. By this means, the server 300 obtains the count result that is the sum of the number of the sheets P which is automatically counted, and the number of the sheets P which the operator has confirmed As described above, the sheet processing apparatus 100 discriminates the kind of the batch card 53, and switches the processing mode in accordance with the discriminated kind of the batch card 53. By this means, the sheet processing apparatus 100 can automatically switch the processing mode without stop. As a result, a sheet processing method, a sheet processing apparatus, and a sheet processing system which can process a sheet more efficiently are provided.

In addition, in the above-described embodiment, the description has been made such that the bundle 55 is composed of the one batch card 53 and a plurality of the sheets P, but the embodiment is not limited to this configuration. The bundle 55 may be configured with a shape in which a plurality of the sheets P are sandwiched by the two batch cards 53.

Figure 10:
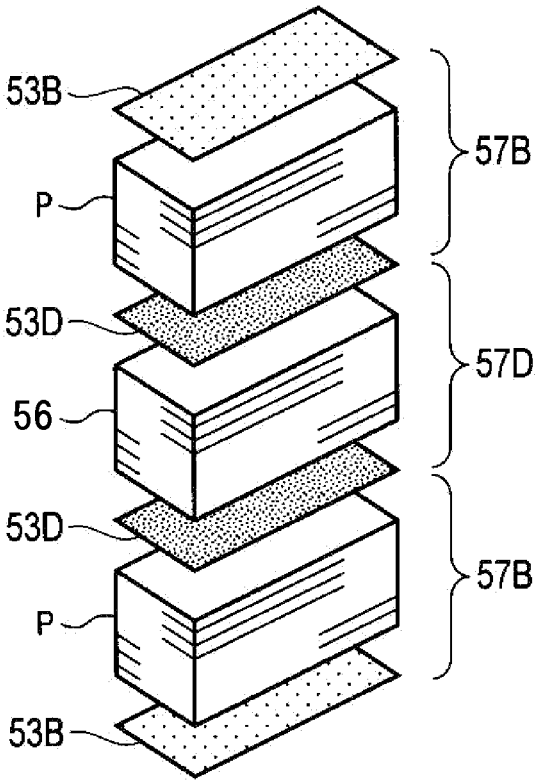
FIG. 10 is a view for describing the sheet processing apparatus according to the embodiment.

FIG. 10 shows an example of bundles 57 of the sheets to be inserted into the sheet processing apparatus 100. A bundle 57B is a bundle in which a plurality of the sheets P are inserted between the two batch cards 53B with a yellow sheet surface. In addition, a bundle 57D is inserted between the bundles 57B. The bundle 57D is a bundle in which a plurality of the calibration cards 56 are inserted between the two batch cards 53D with a blue sheet surface.

When the bundle of the sheets as shown in FIG. 10 is inserted, the sheet processing apparatus 100 firstly discriminates the batch card 53B, and processes the sheets P by the normal mode. Next, when detecting the batch card 53D, the sheet processing apparatus 100 switches the processing mode to the maintenance mode. In this case, the sheet processing apparatus 100 holds the count result of the sheets P after the processing mode is switched to the normal mode. For example, the sheet processing apparatus 100 saves the count result in the memory 151*b*.

The sheet processing apparatus 100 performs calibration using the calibration cards 56 subsequent to the batch card 53D. Furthermore, when detecting the batch card 53D next, the sheet processing apparatus 100 returns the processing mode to the original processing mode. That is, when detecting the batch card 53D next, the sheet processing apparatus 100 returns the processing mode to the normal mode that is the original processing mode. Furthermore, the sheet processing apparatus 100 calls again the count result which has been saved in the memory 151*b*. By this means, the sheet processing apparatus 100 resumes continuing counting in the normal mode.

When detecting the batch card 53B next, the sheet processing apparatus 100 correlates the count result with the identification information of the batch card 53B as an inspection result, and outputs the inspection result to the server 300.

The sheet processing apparatus 100 like this can make the processing by the other processing mode to be interrupted, while executing the processing by a certain processing mode. As a result, a sheet processing method, a sheet processing apparatus, and a sheet processing system which can process a sheet more efficiently are provided.

In addition, the sheet processing apparatus 100 may be configured such that the count result is saved for each processing mode. By this means, the sheet processing apparatus 100 can make the processing by a more plurality of processing modes to be interrupted.

In addition, when the batch card 53 is taken along with the other sheet P, there is a possibility that the sheet processing apparatus 100 can not detect the batch card. Accordingly, the batch card detector 111 may be configured to detect both colors of the surface and rear face of the batch card 53. In addition, the sheet processing apparatus 100 may be configured to detect both colors of the surface and rear face of the batch card 53 by the image readers 117 and 118. In this case, when the different colors are detected on the surface and rear face by the image readers 117 and 118, the sheet processing apparatus 100 judges as overlapped taking of the two sheets is generated, and stops the processing. By this means, it is possible to prevent that the batch card is not detected, and thereby the processing mode is not surely switched.

In addition, in the above-described embodiment, the description has been made such that the sheet processing apparatus 100 is configured to discriminate the kind of the batch card 53 by a color, but the sheet processing apparatus 100 is not limited to this configuration. The sheet processing apparatus 100 may be configured to discriminate the kind of the batch card 53 based on the shape, perforation, or other structural characteristic.

FIG. 11 shows another example of the other batch cards 53. FIG. 11 shows an example of the batch cards 53 which make the sheet processing apparatus 100 discriminate the kinds thereof by the number of perforations 533, respectively.

As shown in FIGS. 11A-D, as the batch cards 53, there are a plurality of kinds, such as, a batch card 53E without the perforation 533, a batch card 53F with the one perforation 533, a batch card 53G with the two perforations 533, and a batch card 53H with the three perforations 533. In addition, each of the batch cards 53 has printing of the bar-code 531 in which the identification information is encoded, the character string 532 indicating the identification information, and so on.

The sheet processing apparatus 100 discriminates the kind of the batch card 53 by the batch card detector 111. In this case, the batch card detector 111 is provided with a configuration to detect the number of the perforations 533 performed in the batch card 53. That is, the batch card detector 111 detects the number of the perforations 533 of the batch card 53, and thereby can recognize whether the taken-in batch card 53 is the batch card 53E, 53F, 53G, or 53H.

For example, when the taken-in batch card 53 has no perforation 533, the sheet processing apparatus 100 recognizes to have taken in the batch card 53E. In addition, when the number of the perforations 533 of the taken-in batch card 53 is one, the sheet processing apparatus 100 recognizes to have taken in the batch card 53F. When the number of the perforations 533 of the taken-in batch card 53 is two, the sheet processing apparatus 100 recognizes to have taken in the batch card 53G. When the number of the perforations 533 of the taken-in batch card 53 is three, the sheet processing apparatus 100 recognizes to have taken in the batch card 53H.

For example, when recognizing to have taken in the batch card 53E, the sheet processing apparatus 100 processes the sheet by the all fitness mode. In addition, when recognizing to have taken in the batch card 53F, the sheet processing apparatus 100 processes the sheet by the normal mode. In addition, when recognizing to have taken in the batch card 53G, the sheet processing apparatus 100 processes the sheet by the all unfitness mode. In addition, when recognizing to have taken in the batch card 53H, the sheet processing apparatus 100 processes the sheet by the maintenance mode.

Also with the configuration like this, a sheet processing method, a sheet processing apparatus, and a sheet processing system which can process a sheet more efficiently are provided.

In addition, the function described in each of the above-described embodiments is not only configured using hardware, but also may be realized by making a computer read out a program describing each function using software. In addition, each of the functions may be configured by arbitrarily selecting any of the software and hardware.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing method of a sheet processing apparatus having a plurality of processing modes, comprising:

taking in sheets one by one from a bundle that includes a batch card having identification information and a color;

conveying the sheets which have been taken in;

discriminating a kind of the batch card and the color;

switching the processing mode under execution to a different processing mode of the plurality of processing modes based on the kind of the batch card and the color which have been discriminated;

discriminating and counting the sheets subsequent to the batch card;

storing a count result of the sheets in correlation with the identification information; and sorting the sheets into a stacker based on a discrimination result of the sheets, wherein the processing mode of the sheet processing apparatus is switched to a maintenance mode, based on the kind of the batch card and the color which has been discriminated; and discrimination processing of the sheets is calibrated using a calibration card subsequent to the batch card.

2. The method of claim 1, wherein:

in a case of switching the processing mode of the sheet processing apparatus to the maintenance mode, the count result in the processing mode before switching is stored; and the processing mode of the sheet processing apparatus is returned from the maintenance mode to the processing mode before switching, based on the kind of the batch card and the color which have been discriminated, the stored count result is read out, and discrimination and counting of the sheet is resumed.

3. The method of claim 1, wherein:

a number of perforations of the batch card is detected, and the kind of the batch card is discriminated based on the number of the perforations of the batch card.

4. A sheet processing apparatus having a plurality of processing modes, comprising:

a take in portion to take in sheets one by one from a bundle of the sheets in which includes a batch card having identification information and a color;

a conveying portion to convey the sheets which have been taken in;

a batch card discrimination portion to discriminate a kind of the batch card and the color;

a processing mode switching portion to switch the processing mode under execution to a different processing mode of the plurality of processing modes based on the kind of the batch card and the color which have been discriminated;

a sheet discrimination portion to discriminate and count the sheets subsequent to the batch card;

a memory portion to store a count result of the sheets in correlation with the identification information; and a sorting processing portion to sort the sheets into a stacker based on a discrimination result of the sheet, wherein the processing mode of the sheet processing apparatus is switched to a maintenance mode, based on the kind of the batch card and the color which has been discriminated; and discrimination processing of the sheets is calibrated using a calibration card subsequent to the batch card.

5. A sheet processing system provided with a sheet processing apparatus having a plurality of processing modes, and a server to store a count result of sheets by the sheet processing apparatus, comprising:

the sheet processing apparatus, including:

a take in portion to take in the sheets one by one from a bundle of the sheets in which a batch card having identification information and a color is included;

a conveying portion to convey the sheets which have been taken in;

a batch card discrimination portion to discriminate a kind of the batch card and the color;

a processing mode switching portion to switch the processing mode under execution to a different processing mode of the plurality of processing modes based on the kind of the batch card and the color which have been discriminated;

a sheet discrimination portion to discriminate and count the sheets subsequent to the batch card;

a transmission portion to correlate the count result of the sheets with the identification information as an inspection result and transmit the inspection result to the server; and a sorting processing portion to sort the sheets into a stacker based on a discrimination result of the sheets;, wherein the processing mode of the sheet processing apparatus is switched to a maintenance mode, based on the kind of the batch card and the color which has been discriminated; and discrimination processing of the sheets is calibrated using a calibration card subsequent to the batch card; and the server including:

a memory portion to store the inspection result transmitted from the sheet processing apparatus.

* * * * *